United States Patent [19]

Pruehs et al.

[11] Patent Number: 4,898,621

[45] Date of Patent: Feb. 6, 1990

[54] USE OF HYDROXYALKYL POLYETHYLENE GLYCOL ETHERS AS SURFACTANTS IN RINSE AIDS FOR DISHWASHING MACHINES

[75] Inventors: Horst Pruehs; Gilbert Schenker, Erkrath; Theodor Altenschoepfer, Duesseldorf; Robert Piorr, Ratingen-Hoesel, all of Fed. Rep. of Germany

[73] Assignee: Henkel Kommanditgesellschaft auf Aktien, Duesseldorf, Fed. Rep. of Germany

[21] Appl. No.: 220,142

[22] Filed: Jul. 15, 1988

[30] Foreign Application Priority Data

Jul. 18, 1987 [DE] Fed. Rep. of Germany ..... 3723873

[51] Int. Cl.[4] ..... C11D 1/72; C11D 3/20

[52] U.S. Cl. ..... 134/25.2; 134/26; 134/29; 252/19; 252/135; 252/174.16; 252/174.21; 252/174.22; 252/351; 252/DIG. 1

[58] Field of Search ..... 134/25.2; 252/174.21, 252/174.22

[56] References Cited

U.S. PATENT DOCUMENTS 3,242,200 3/1966 Johnson ..... 260/398
3,563,901 2/1971 Crotty ..... 252/136
3,969,134 7/1976 Batka et al. ..... 134/26
4,600,523 7/1986 Piorr et al. ..... 252/174.22

FOREIGN PATENT DOCUMENTS 2432757 1/1976 Fed. Rep. of Germany .

*Primary Examiner*—A. Lionel Clingman
*Attorney, Agent, or Firm*—Ernest G. Szoke; Wayne C. Jaeschke; Real J. Grandmaison

[57] ABSTRACT

The invention relates to the use of hydroxyalkyl polyethylene glycol ethers corresponding to the following general formula

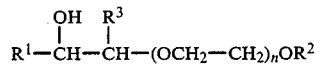

$$R^1-\underset{\displaystyle OH}{CH}-\underset{\displaystyle R^3}{CH}-(OCH_2-CH_2)_nOR^2 \quad (I)$$

in which
$R^1$ is hydrogen or a linear $C_1$–$C_{16}$ alkyl radical,
$R^2$ is a linear or branched $C_4$–$C_8$ alkyl radical,
$R^3$ is hydrogen or a $C_1$–$C_{16}$ alkyl radical and
n is a number of 7 to 30 with the proviso that the total number of carbon atoms in $R^1$ and $R^3$ is 6 to 16, and mixtures thereof in rinse aid compositions for dishwashing machines in addition to other additives typically used in rinse aids.

10 Claims, No Drawings

USE OF HYDROXYALKYL POLYETHYLENE GLYCOL ETHERS AS SURFACTANTS IN RINSE AIDS FOR DISHWASHING MACHINES

BACKGROUND OF THE INVENTION

1. Field of the Invention

This invention relates to the use of hydroxyalkyl polyethylene glycol ethers in rinse aids for dishwashing machines.

In machine dishwashing, there are generally two rinse cycles in which different detergents are used and which are mostly separated by intermediate rinses with clean water. Alkaline detergents are used in the actual wash cycle to detach and emulsify food remains left on the dishes. By contrast, special rinse aids are used in the so-called final-rinse cycle. Rinse aids are not detergents, but are intended to have good wetting power and to reduce the surface tension of the final-rinse water to such an extent that it drains from the dishes like a film and leaves behind no visible residues which could lead to lime stains or other marks.

On account of the vigorous liquor movement both in domestic and in institutional dishwashing machines, the rinse aids have to be low-foam formulations. Conventional anionic wetting agents, such as relatively high molecular weight alkyl sulfates or alkyl or alkylaryl sulfonates, show a pronounced tendency towards foaming so that they are not suitable for use as rinse aids. Rinse aids based on nonionic surfactants, for example ethylene oxide adducts with fatty alcohols, alkylphenols or polypropylene glycols of relatively high molecular weight, are now widely used in practice.

However, it has been found that, in general, rinse aids containing nonionic surfactants such as these also produce too much foam in the concentration ranges required for an adequate wetting effect. They easily lead to problems in the machines through excessive and stable foaming. This is due to the fact, above all in institutional dishwashing machines with very intensive water circulation, that the final-rinse liquor which has a temperature of about 80° C. is returned to the main wash cycle where it comes into contact with the alkaline detergents at 50° to 70° C. In these zones of the dishwashing machines, foaming is further promoted by food remains present in the wash liquor. Although difficulties such as these arise on only a reduced scale in domestic dishwashing machines, they occur in principle to the same extent.

Accordingly, it is necessary to add foam inhibitors to the rinse aids, even where relatively low-foam ethylene oxide adducts are used. Suitable foam initiators include nonionic alkoxylation products which are poorly soluble in water at final-rinse temperatures. Products such as these include ethylene oxide adducts with higher alcohols, alkylphenols or amines having a low degree of ethoxylation or corresponding adducts of ethylene oxide and propylene oxide or propylene oxide and ethylene oxide in any order and in any ratio. However, compounds such as these do not have any wetting effect at in-use temperatures and, accordingly, are a burden on the rinse aid.

2. Discussion of Related Art

However, extremely low-foam, biodegradable rinse aids which exclusively contain constituents acting as wetting agents and which make it unnecessary to add foam-inhibiting ballast surfactants or other foam inhibitors are also known from German Patent 21 06 819. The rinse aids therein are for dishwashing machines based on nonionic, low-foam surfactants containing adducts of 5 to 20 mol ethylene oxide and 1 to 10 mol propylene oxide with secondary aliphatic alcohols containing a linear $C_{10}$–$C_{20}$ alkyl chain. The adducts mentioned exhibit an excellent draining and clear drying effect both on standard items such as china plates, cutlery and on glasses which are particularly difficult to rinse in the final rinse cycle. The biodegradability requirements prevailing at that time were satisfied. However, the compounds mentioned do not satisfy current legal requirements on the biodegradability of compounds entering the wastewater.

Hydroxyalkyl polyethylene glycol ethers corresponding to the following general formula $$R^1-\underset{}{\overset{OH}{\overset{|}{CH}}}-\overset{R^3}{\overset{|}{CH}}-(OCH_2-CH_2)_nOR^2 \qquad (I)$$

in which $R^1$ is a linear $C_6$–$C_{16}$ alkyl radical, $R^2$ is a linear or branched $C_4$–$C_8$ alkyl radical, $R^3$ is hydrogen or a $C_1$–$C_8$ alkyl radical and n is a number of 7 to 12, are known from German patent application 33 45 349. The use of these compounds as foam-inhibiting additives in low-foam cleaning preparations is also described in this publication. The principal advantage of the described compounds (I) is not only their pronounced low-foam character, but also their high stability to acids and, in particular, alkalis which is absolutely essential for cleaning preparations on account of the high alkali concentrations generally present in cleaning preparations. In addition, the described compounds (I) possess extremely good biodegradability which even satisfies current legal requirements.

DESCRIPTION OF THE INVENTION

Other than in the operating examples, or where otherwise indicated, all numbers expressing quantities of ingredients or reaction conditions used herein are to be understood as modified in all instances by the term "about".

It has now surprisingly been found that the aforementioned compounds are extremely suitable for use as the sole surfactant component in rinse aids for dishwashing machines because, as described in the prior art, not only are they resistant to acids and alkalis, show good biodegradability and are distinguished by their pronounced low-foam character, they also demonstrate an excellent clear drying effect by virtue of their high wetting power; a fact which was not evident from the prior art.

Accordingly, the present invention relates to a rinse aid composition for a dishwashing machine comprising a hydroxyalkyl polyethylene glycol ether corresponding to the following general formula $$R^1-\overset{OH}{\overset{|}{CH}}-\overset{R^3}{\overset{|}{CH}}-(OCH_2-CH_2)_nOR^2 \qquad (I)$$

in which $R^1$ is hydrogen or a linear $C_1$–$C_{16}$ alkyl radical, $R^2$ is a linear or branched $C_4$–$C_8$ alkyl radical, $R^3$ is hydrogen or a $C_1$–$C_{16}$ alkyl radical and n is a number of 7 to 30, with the proviso that the total number of carbon atoms in $R^1$ and $R^3$ is 6 to 16, in addition to other additives typically used in a rinse aid composition.

The compounds used in accordance with the invention correspond to general formula (I). In this general formula, $R^1$ is a linear $C_1$–$C_{16}$ alkyl radical. Accordingly, the alkyl radicals herein include the methyl, ethyl, n-propyl, n-butyl, n-pentyl, n-octyl, n-nonyl, n-decyl, n-undecyl, n-dodecyl, n-tridecyl, n-tetradecyl, n-pentadecyl and n-hexadecyl radicals. A preferred embodiment of the invention is characterized by the use of hydroxyalkyl polyethylene glycol ethers corresponding to general formula (I), in which $R^1$ is a linear $C_{12}$–$C_{16}$ alkyl radical. When used in rinse aids, hydroxyalkyl polyethylene glycol ethers such as these corresponding to general formula (I) provide for particularly good draining behavior of the rinse water.

In the above general formula (I) of the compounds suitable for use in accordance with the invention, $R^2$ is a linear or branched $C_4$–$C_8$ alkyl radical. Accordingly, suitable $R^2$ substituents include the radicals n-butyl, n-pentyl, n-hexyl, n-heptyl and n-octyl and also the respective branched isomers of the alkyl radicals mentioned. Since alcohols wherein the alkyl radical corresponds to $R^2$ in general formula (I) above are used as starting materials for the production of the compounds corresponding to general formula (I), linear or branched alcohols containing 4 to 8 carbon atoms in the alkyl radical are preferably used for the production of the compounds corresponding to general formula (I). Alcohols such as these are understood to be alcohols selected from group consisting of n-butanol, i-butanol, n-amyl alcohol, i-amyl alcohol, n-hexanol and also the remaining isomeric hexanols, n-heptanol and branched-chain isomers thereof and also n-octanol and branched-chain isomers thereof, such as for example 2-ethylhexanol. The afore-mentioned alcohols may be used either individually or in admixture for the production of the compounds corresponding to general formula (I), which is described in more detail hereinafter. The result is that the compounds corresponding to general formula (I) are also formed as mixtures rather than exclusively as individual compounds. Accordingly, mixtures of the compounds may also be considered for the use of the afore-mentioned compounds corresponding to general formula (I) in rinse aids. This embodiment is within the present invention. In one particularly preferred embodiment of the use according to the invention, compounds of general formula (I), in which $R^2$ is an n-butyl radical, are present in the rinse aid composition.

Compounds corresponding to general formula (I), in which $R^3$ is hydrogen or a linear $C_1$–$C_{16}$ alkyl radical, are used in rinse aids in accordance with the invention. In addition to hydrogen, therefore, the substituent $R^3$ may consist of the same alkyl radicals as mentioned for $R^1$.

A preferred embodiment according to the invention is characterized by the use of hydroxyalkyl polyethylene glycol ethers corresponding to general formula (I), in which $R^1$ is a linear $C_{12}$–$C_{16}$ alkyl radical and $R^3$ is hydrogen. Compounds such as these provide for particularly good clear rinsing effects. In addition, they are obtainable from corresponding epoxides in which the oxirane ring is terminal and which are therefore particularly suitable for reaction to compounds corresponding to general formula (I).

In general formula (I) of the hydroxyalkyl polyethylene glycol ethers suitable for use in accordance with the invention, n is a number of 7 to 30. This merely means that, in the production of the compounds corresponding to general formula (I), the starting alcohol from the group mentioned above is ethoxylated with ethylene oxide in a molar ratio of 1:7 to 1:30. The corresponding number of recurring ethoxy units is thus also present in the compounds of general formula (I) used in accordance with the invention. Compounds (I), of the general formula in which n is a number of 8 to 16, are preferably used. Particularly good clear rinsing effects are obtained with compounds (I), of the general formula in which n is a number of 9 to 14, by virtue of their good wetting behavior.

As described above, linear or branched $C_4$–$C_8$ alcohols are used as a starting material for the production of the hydroxyalkyl polyethylene glycol ethers of general formula (I) either individually or even in admixture, for example in the form of a mixture of several isomers. In such case, the reagent for the alcohols mentioned is ethylene oxide, the molar ratio between the reagents for the ethoxylation reaction (alcohol:ethylene oxide) being from 1:7 to 1:30. Accordingly, n in the starting materials for the production of the compounds of general formula (I) used in accordance with the invention is a number in the range from 7 to 30.

The alcohol ethoxylates obtained are reacted with $C_{10}$–$C_{18}$ epoxides for the production of the compounds (I) used in accordance with the invention. Both 1,2-epoxides and also compounds containing an internal oxirane ring may be used for this reaction. Epoxides containing a terminal oxirane ring and 12 to 16 carbon atoms in the alkyl radical R have proved to be particularly suitable. Mixtures of epoxides of different chain length may be introduced into the reaction for the production of the compounds (I) used in accordance with the invention. The reaction normally takes place in the presence of suitable, generally alkaline catalysts. They are added to the reaction mixture in a quantity of 0.1 to 1% by weight, based on the quantity of epoxide used. The molar ratio of alcohol alkoxylate to epoxide for the reaction is preferably in the range of 1:1. During the reaction, which normally takes several hours, the reaction mixture is heated to a temperature in the range of from 100° to 200° C., and preferably to a temperature in the range of from 120° to 180° C. The conversion level may readily be determined by determining the epoxide content of the mixture. In general, a reaction time of 4 to 8 hours at 150° to 170° C. is sufficient.

According to the invention, the compounds corresponding to general formula (I) above may be used as the sole surfactant component in rinse aids. Rinse aids containing hydroxyalkyl polyethylene glycol ethers corresponding to general formula (I) as the sole surfactant component not only have the advantage over the prior art of producing very little foam, they also ensure that this surfactant component does not give rise to any problems associated with biodegradability requirements. In addition, rinse aids of the type herein show excellent wetting behavior. Even drinking glasses the final rinsing of which way always regarded as a problem in the prior art are satisfactorily rinsed clean and may thus be rinsed with a satisfactory clear drying effect, i.e. without stains and streaks, even with dishwashing detergents of the type typically used in institutional dishwashing machines.

It is of course also possible within the scope of the invention to blend the hydroxyalkyl polyethylene glycol ethers corresponding to general formula (I) with a small quantity of other nonionic surfactants. This may be done, for example, to reduce the cost of the formulation. Suitable other nonionic surfactants include, for example, sufficiently biodegradable ethylene oxide adducts with fatty alcohols or adducts of propylene oxide or butylene oxide with fatty alcohol ethoxylates. The quality of the rinse aids containing the hydroxyalkyl polyethylene glycol ethers corresponding to general formula (I) used in accordance with the invention is not significantly affected and, in particular, is not adversely affected. As emphasized above, however, it is preferred to use a hydroxyalkyl polyethylene glycol ether corresponding to general formula (I) or mixtures of two or more such compounds without the addition of other nonionic surfactants in rinse aids.

The compounds (I) in accordance with the invention are used in the rinse aids in a concentration of from 5 to 65% by weight, based on the total weight of the rinse aid. In accordance with the "aqueous" rinsing process, it is preferred to use aqueous solutions which provide for rapid dispersion and dissolution of the compounds (I) in the rinsing liquid. The preferred concentration range from the use of the compounds (I) is 15 to 50% by weight, based on the total weight of the rinse aid.

It is also possible within the scope of using the compounds of general formula (I) according to the invention to add to the rinse aids other substances of the type typically used in rinse aids. Thus, it may be appropriate with a view to obtaining adequate low temperature stability to incorporate solubilizes in the formulations. Suitable solubilizers include monohydric or polyhydric alcohols, of which ethanol, n-propanol, i-propanol, ethylene glycol and propylene glycol are preferred.

Other suitable solubilizers include the alkali metal salts of low molecular weight alkylbenzenesulfonic acids, such as sodium cumene sulfonate, sodium xylene sulfonate or sodium toluene sulfonate, which are known from the prior art.

The afore-mentioned solubilizers may be used in a quantity of from 0 to 40% by weight, based on the rinse aid as a whole. In addition to other parameters, the exact quantity thereof is determined by the cloud point of the surfactant used and by the desired stability in storage and may be varied as required within the limits mentioned without in any way affecting the excellent final rinse effects obtained by using the compounds of general formula (I).

In addition to the use of the compounds of general formula (I), other substances of the type typically used in rinse aids may also be added. In this connection, particular mention is made of complexing agents which are intended to prevent the deposition of lime residues on the dishes where unsoftened water is used in the final rinse. The complexing agents may be added in a quantity of 0 to 40% by weight, and preferably in a quantity of 10 to 35% by weight, based on the rinse aid as a whole. Complexing agents which have been successfully used in this regard include for example, citric acid, tartaric acid, glycolic acid, nitrilotriacetic acid or commercially available technical mixtures of succinic acid, glutaric acid and adipic acid (obtainable under the trade name ∓Sokalan DSC ®" from BASF). It is also possible to use complexing agents having threshold-active properties providing they are physiologically acceptable and, hence, may be used for the machine dishwashing of articles which come into contact with foods. Suitable complexing agents of this type include for example, 2-phosphonobutane-1,2,4-tricarboxylic acid and comparable compounds. The former is available, for example, under the trade name "Bayhibit AM ®". Ths in-use concentration of these complexing agents may be lower than for the complexing agents mentioned above, amounting to between 0 and 10% by weight, and preferably to between 2 and 7% by weight, based on the rinse aid as a whole.

In addition to the hydroxyalkyl polyethylene glycol ethers (I) and the substances mentioned above, dyes, perfumes and preservatives of the type typically used in rinse aids may also be added in the usual way. Auxiliaries such as these do not in any way affect the final rinse behavior of the compounds (I).

The invention is illustrated by the following Examples.

EXAMPLE I

This example illustrates the preparation of a compound corresponding to general formula (I) wherein $R^1$=n-dodecyl, $R^2$=n-butyl, $R^3$=H, and n=10.

484 g (1 mol) of the adduct of 10 mol ethylene oxide with 1 mol n-butanol, 227.5 g (1 mol) of linear 1,2-epoxytetradecane and 1.3 g sodium methanolate (30% solution in methanol) were heated in vacuo to 100° C. to remove the methanol introduced with the catalyst and were then heated with stirring for 6 hours at 160° C. in an inert gas atmosphere. After cooling, the reaction product was neutralized with an equivalent quantity of acetic acid and filtered. The analytically determined hydroxyl number of the product was 80. Its cloud point in water, as determined in accordance with DIN 53 917, was 28° C.

EXAMPLES II TO VIII

Further compounds corresponding to general formula (I) were prepared by the method described in Example I. The characteristic structural data and also the cloud points of the compounds obtained, as determined in water in accordance with DIN 53 917, are shown in Table 1 below.

TABLE 1

Compounds of general formula (I) according to Examples II to VIII ($R^3$ = H)

| Example | $R^1$ | $R^2$ | n | Cloud point in water (°C.) |
|---|---|---|---|---|
| II | n-octyl | n-butyl | 9 | 31 |
| III | n-tetradecyl | n-butyl | 9 | 24 |
| IV | n-dodecyl | n-hexyl | 10 | 25 |
| V | n-decyl | n-butyl | 11 | 31 |
| VI | n-dodecyl | n-butyl | 14 | 42 |
| VII | n-dodecyl | n-butyl | 19 | 54 |
| VIII | n-decyl | n-butyl | 29 | 66 |

EXAMPLE IX

This example describes the determination of foaming behavior of the compounds of examples I to VIII.

The foaming behavior of the rinse-aid surfactants (0.2 g/l) was determined in 200 ml of an aqueous alkaline detergent liquor containing alkali metal triphosphates, alkali metal silicates, potassium hydroxide and chlorine bleaching liquor (3 g/l Perclin intensiv Flüssigreiniger ®(Intensive Liquid Detergent), a product of Henkel KGaA) by a foam beating test (hand beating method according to DIN 53 902). The water was softened, the temperature was 65° C. The liquor was beaten 20 times in a measuring cyclinder and the foam height read off after 10, 30 and 60 seconds.

Alkalinity and temperature correspond to the conditions prevailing in an institutional dishwashing machine.

2 g/l freshly beaten fresh egg was additionally incorporated in these mixtures in order to test the food-foam-inhibiting effect. The results of the test are shown in Table 2 below.

TABLE 2

Foaming behavior of the compounds of Examples I to VIII

| Compound of Example Number | Foam height in ml without fresh eggs | | | Foam height in ml with fresh egg | | |
|---|---|---|---|---|---|---|
| | After 10 secs | After 30 secs | After 60 secs | After 10 secs | After 30 secs | After 60 secs |
| I | 10 | 10 | 10 | 15–20 | 15 | 15 |
| II | 5 | 5 | 0–5 | 20 | 15 | 15 |
| III | 0–5 | 0–5 | 0–5 | 10 | 5–10 | 5–10 |
| IV | 10 | 10 | 10 | 15 | 15 | 15 |
| V | 10 | 5 | 5 | 10 | 5–10 | 5–10 |
| VI | 7 | 7 | 5 | 15 | 10 | 8 |
| VII | 10 | 9 | 7 | 22 | 18 | 15 |
| VIII | 43 | 40 | 35 | 60 | 50 | 45 |
| Without Surfactant | 0 | 0 | 0 | 160 | 160 | 160 |

RESULT

These compounds were extremely low-foaming and effectively inhibited the food foam without further additions of foam inhibitors.

EXAMPLE X

This example illustrates the testing of biological degradability of compounds.

The biological degradability of the claimed adducts was tested by the OECD Screening Test (ruling under German detergent legislation) and was expressed as the reduction in BiAS (Biodegradable Active Substance) after 19 days.

Degradability was also measured by the CB (closed bottle) ready biodegradability test prescribed under chemical legislation (BOD—biological oxygen demand/COD—chemical oxygen demand).

The values were determined for the compounds of Example I and for two comparison products. They are shown in Table 3 below.

TABLE 3 uz,7/26 Results of biological degradability tests

| | % BiAS reduction after 19 days | % BOD/COD after 30 days |
|---|---|---|
| Compound of Example I | 92 | 58 |
| Comparison product I (sec. $C_{11}$–$C_{15}$ fatty alcohol + 8 EO + 5 PO; Cloud point: 33° C.) | 77 | 20 |
| Comparison product II ($C_{12}$–$C_{14}$ fatty alcohol + 5 EO + 4 PO; Cloud point: 28° C.) | 96 | 40–50 |

RESULT

Accordingly, the degradability requirement under EEC guidelines is fully satisfied.

EXAMPLES XI TO XV

These examples illustrate the practical testing of various rinse aid compositions containing compounds corresponding to general formula (I):

EXAMPLE XI

A rinse aid having the following composition was tested in a domestic dishwashing machine:

15.0% compound of Example V
8.0% Na cumene sulfonate
10.0% citric acid (anhydrous)
0.3% lemon perfume oil
66.7% water (fully deionized)

When the rinse aid composition was used in a 65° C. final rinse, an excellent clear drying effect was obtained, particularly on glasses, in the tested use-concentration range of 0.1 to 0.8 g/l rinse aid.

EXAMPLE XII

33% compound of Example I
3% Na toluene sulfonate
64% water (fully deionized)

In an institutional multiple tank installation, this formulation produced no troublesome foaming in any of the zones (65° C. wash zone, 43° C. pre-removal zone with heavy soiling). The clear drying effect was good throughout the entire use-concentration range from 0.1 to 1.3 g/l.

EXAMPLE XIII

8% compound of Example VIII
17% compound of Example I
10% isopropanol
65% water

In this example, the compound of example VIII which, although foaming to a greater extent above 40° C., had a better wetting effect was combined with the compound of Example I which was low-foaming beyond 30° C. to produce a rinse aid providing low-foaming beyond 40° C. with a good wetting effect on plastic items.

The test was carried out with a use-concentration of 0.8 g/l in an institutional multiple tank dishwashing machine with good clear drying results.

EXAMPLE XIV

A hydroxyalkyl polyethylene glycol ether (I) was combined with a fatty alcohol ethylene glycol/propylene glycol ether and tested in an institutional single-tank machine.

15% compound of Example III
10% $C_{12}$–$C_{14}$ fatty alcohol+5 EO+4 PO
4% Na cumene sulfonate
10% citric acid
5% Sokalan DCS ®(dicarboxylic acid mixture, cf. page 10, line 23)
56% water The rinse aid was low-foaming beyond 30° C. and, in a use-concentration of 0.1 to 1.0 g/l, produced a good clear drying effect without troublesome foaming in the dishwashing of lightly soiled lunch dishes.

EXAMPLE XV 25.0% compound of Example VI
1.0% Na cumene sulfonate
1.0% 2-phosphonobutane-1,2,4-tricarboxylic acid (Bayhibit Am ®)

0.4% Na benzoate
72.6% water

The rinse aid was low-foaming in the in-use liquor beyond 43° C. Both in a domestic dishwashing machine and in an institutional dishwashing machine, a good clear drying effect was obtained with 0.1 to 1.0 g/l.

EXAMPLE XVI

This example illustrates the comparative testing of the clear drying effect of two of the surfactants used in accordance with the invention with that of a less readily biodegradable surfactant (secondary $C_{11}$–$C_{15}$ alcohol+8 EO+5 PO). The tests were carried out in a domestic dishwashing machine (softened water; 300 mg salt burden) with one wash cycle and one final-rinse cycle, marks from 1 (very poor) to 10 (optimal clear drying; highest possible mark) being awarded. The dosage of the surfactants in the after rinse cycle was 0.02 to 0.1 g/l. Drinking glasses were used as the test items because they are the most sensitive to staining, streaking and spoting. The fact that the mark 10 was not given is due to the very critical marking and to the fact that the water used was softened, but not deionized. A mark of 10 is only possible where fully deionized water is used.

TABLE 4

Evaluation of the clear drying effect

| Rinse aid | Clear drying effect mark for a surfactant dose (g/l) of 0.02 | 0.06 | 0.1 |
|---|---|---|---|
| Compound of Example V | 5.8 | 6.0 | 5.7 |
| Compound of Example VI | 6.3 | 6.0 | 6.2 |
| Comparison product (German Patent 21 06 819; secondary $C_{11}$–$C_{15}$ fatty alcohol + 8 EO + 5 PO; Cloud point: 34° C.) | 6.1 | 6.0 | 5.7 |

RESULT

It was found that the clear drying effect mark for the readily biodegradable hydroxyalkyl polyethylene glycol ethers (I) used in accordance with the invention is comparable with or better than that of the tested comparison product which was distinctly less readily biodegradable in the CB/COD test.

We claim:

1. The process of rinsing dishes and glassware in a dishwashing machine comprising adding thereto a rinse aid composition containing a hydroxyalkyl polyethylene glycol ether corresponding to the following formula $$R^1-\underset{}{\overset{OH}{\overset{|}{CH}}}-\overset{R^3}{\overset{|}{CH}}-(OCH_2-CH_2)_nOR^2 \quad (I)$$

in which
$R^1$ is hydrogen or a linear $C_1$–$C_{16}$ alkyl radical,
$R^2$ is a linear or branched $C_4$–$C_8$ alkyl radical,
$R^3$ is hydrogen or a $C_1$–$C_{16}$ alkyl radical and
n is a number of from about 7 to about 30,
with the proviso that the total number of carbon atoms in $R^1$ and $R^3$ is from about 6 to about 16, and mixtures of said ether.

2. The process as in claim 1 wherein $R^1$ is a linear $C_{12}$–$C_{16}$ alkyl radical and $R^3$ is hydrogen.

3. The process as in claim 1 wherein $R^2$ is an n-butyl radical.

4. The process as in claim 1 wherein n is a number of from about 8 to about 16.

5. The process as in claim 1 wherein $R^1$ is a linear $C_{12}$–$C_{16}$ alkyl radical, $R^2$ is an n-butyl radical, $R^3$ is H and n is a number of 9 to 14.

6. The process as in claim 1 wherein said ether is present therein in an amount of from about 5 to about 65% by weight, based on the weight of said composition.

7. The process as in claim 1 wherein said composition also contains a solubilizer, hydrotrope, complexing agent, or threshold-active complexing agent.

8. The process as in claim 7 wherein said threshold-active complexing agent comprises 2-phosphonobutane-1,2,4-tricarboxylic acid present in an amount of from about 2 to about 7% by weight, based on the weight of said composition.

9. The process as in claim 1 wherein said composition also contains from about 10 to about 35% by weight of a complexing agent selected from citric acid, tartaric acid, glycolic acid, nitrilotriacetic acid, succinic acid, glutaric acid and adipic acid, based on the weight of said composition.

10. The process of rinsing dishes and glassware in a dishwashing machine comprising adding thereto a rinse aid composition comprising from about 5 to about 65% by weight of a hydroxyalkyl polyethylene glycol ether corresponding to the following formula $$R^1-\overset{OH}{\overset{|}{CH}}-\overset{R^3}{\overset{|}{CH}}-(OCH_2-CH_2)_nOR^2 \quad (I)$$

in which
$R^1$ is hydrogen or a linear $C_1$–$C_{16}$ alkyl radical,
$R^2$ is a linear or branched $C_4$–$C_8$ alkyl radical,
$R^3$ is hydrogen or a $C_1$–$C_{16}$ alkyl radical and
n is a number of from about 7 to about 30,
with the proviso that the total number of carbon atoms in $R^1$ and $R^3$ is from about 6 to about 16, and mixtures of said ether, from about 10 to about 35% by weight of a complexing agent selected from citric acid, tartaric acid, glycolic acid, nitrilotriacetic acid, succinic acid, glutaric acid and adipic acid, based on the weight of said composition, and a solubilizer, hydrotrope, or threshold-active complexing agent.

* * * * *